US005528947A

United States Patent [19]

Wang et al.

[11] Patent Number: 5,528,947

[45] Date of Patent: Jun. 25, 1996

[54] ROD PUMPING ASSEMBLY

[76] Inventors: Pucheng Wang, No. 12, Xiaogouping, Lanzhou, Gansu; Jia Wang, Xuzhou Machinery Factory of East-China Oil-Transfer Administration, Xuzhou; Qi Wang, Tool-Sub-Factory of Lanzhou Petrochemical Machine Factory, Lanzhou, all of China

[21] Appl. No.: 169,637

[22] Filed: Dec. 20, 1993

[30] Foreign Application Priority Data

Dec. 21, 1992 [CN] China ..... 9211506.3
May 21, 1993 [CN] China ..... 93105993.3

[51] Int. Cl.[6] ..... F16H 21/20

[52] U.S. Cl. ..... 74/41; 74/589; 74/590; 74/603; 417/218

[58] Field of Search ..... 74/41, 589 X, 74/590 X, 603 X; 166/75.1; 417/212, 218 X

[56] References Cited

U.S. PATENT DOCUMENTS 2,640,425 6/1953 Saalfrank ..... 74/41
3,029,650 4/1962 Byrd ..... 74/41
3,221,569 12/1965 Ross ..... 74/41
3,406,581 10/1968 Eyler et al. ..... 74/41
4,484,484 11/1984 Wissink et al. ..... 74/41

FOREIGN PATENT DOCUMENTS 88107522 6/1993 China .

*Primary Examiner*—Rodney H. Bonck
*Assistant Examiner*—David Fenstermacher
*Attorney, Agent, or Firm*—Popham, Haik, Schnobrich & Kaufman, Ltd.

[57] ABSTRACT

A rod pumping unit used in the oil field, which has high efficiency and saves power, characterized in that: for the connection of the 2ω crank and the main crank in the 2ω crank balance device there is provided a differential phase adjusting mechanism, for the walking beam balance there is provided beam balance mass lowering device having positioning mechanism or self positioning mechansim, these devices can be adjusted manually in non-stopped status or by computer. The advantages of the pumping unit of the present invention are that the torque fluctuation of the speed reducer is small, the negative work of the power machine is eliminated and the power consumption and the total weight of the machine are decreased greatly. The present invention may save power and material to 50% as compared with the conventional beam pumping unit.

19 Claims, 15 Drawing Sheets

ROD PUMPING ASSEMBLY

BACKGROUND OF THE INVENTION

1. Field of the Invention

The present invention relates to a walking beam rod pumping assembly used in oil fields. More specifically, the invention relates to a double stage balanced rod pumping assembly which can have its balance adjusted in a non-stopped status.

2. Related Art

Conventional walking beam pumping assemblies are commonly used in oil fields. The varieties of the conventional walking beam pumping assemblies include: out of phase crank balanced walking beam pumping assemblies; front driven walking beam pumping assemblies; and pneumatically balanced walking beam pumping assemblies. The feature common to all conventional walking beam pumping assemblies is that the movement changing device is simple in structure, i.e., it is a four-hinge crank-rocker mechanism including a main crank, a connecting rod, a rocker (walking beam or loose pulley), and a stand (formed integrally with a base). Thus, conventional pumping assemblies can be referred to as walking beam (loose pulley) pumping assemblies with four-hinge crank-rocker mechanisms. Since the movement changing device of conventional pumping assemblies is very simple in structure, this kind of pumping assembly has the advantages of reliable structure, convenience in production, simple maintenance and durability and adaptability to various bad conditions of the oil field.

The disadvantages of a conventional walking beam pumping assembly with a four-hinge crank-rocker mechanism are that the fluctuations of torque are large, with large negative torques and large expenditures of power, and the conventional devices require heavy steel structural components.

Chinese Patent Application No. 88107522 (granted to the same applicant on Jun. 24, 1993) disclosed a double stage balance rod pumping assembly, which can eliminate the large negative torques of conventional pumping assemblies, lower the fluctuational range of the torques, save electrical energy expended, and reduce the total weight of the assembly greatly. Therefore, the pumping assembly disclosed in Chinese Patent Application No. 88107522 has overcome many of the disadvantages of the conventional walking beam pumping assemblies having a four-hinge crank-rocker mechanism. However, this kind of pumping assembly can't have its balance adjusted while in a non-stopped status and thus is limited in its ability to benefit from the effect of double stage balancing. The primary and secondary balance torques arc periodic functions of the rotation angles of the cranks having the periods of $2\pi$ and $\pi$ respectively.

SUMMARY OF THE INVENTION

An object of the present invention is to provide a double stage balanced rod pumping assembly which can have its balance adjusted while in a non-stopped status, thus producing a much more significant power saving and reducing the total weight of the assembly, while also allowing the assembly to be controlled by a computer during operation. An embodiment of a rod pumping assembly for use in oil fields according to the present invention comprises a power machine; a speed reducing device; a belt driving means for connecting the speed reducing device to the power machine and for driving the speed reducing device by the power machine; and a four-hinge crank-rocker mechanism including a main crank, a connecting rod, a walking beam or loose pulley and a stand mounted on a base. The four-hinge crank-rocker mechanism changes the rotation of an output shaft of said speed reducing device into an up and down linear movement of a slick rod, which actually performs the drilling operation, wherein the main crank is fixed to an end of the output shaft of the speed reducing device, and the speed reducing device is fixedly connected to the base. The walking beam or loose pulley is hinged with a top end of the stand by means of a bearing and is able to swing about the mandrel or axis of the bearing in a vertical plane. One end of the connecting rod is hinged with the main crank and the other end is hinged with the walking beam or loose pulley at a position deviating from the point at which the walking beam is hinged to the stand. The connecting rod can be connected directly to the walking beam or by means of a cross beam. The walking beam has a "horse head" device or loose pulley device at one end for providing a connection to the slick rod or hinging rope device. A primary balancing device includes a walking beam underset balance mass depending from a rear end of the walking beam, at the end of the beam opposite from the end of the beam having a horse head device, and being semiautomatically adjustable in its position relative to the walking beam. The walking beam underset balance mass creates not only the primary balance torque, which changes approximately according to a sinusoidal function wherein a complete rotation cycle ($2\pi$) of the main crank is one period, but also a secondary balance torque, which changes approximately according to a sinusoidal function wherein a half rotation cycle ($\pi$) of the main crank is one period. A two phase crank secondary balance device is connected with the main crank through a differential phase adjusting device.

In a preferred embodiment, the structure of the differential phase adjusting device comprises a two phase crank gear integrally formed with the two phase crank and being rotatably mounted on an output shaft of the speed reducing device; a planet disc being rotatably mounted on the outer cylindrical surface of the two phase crank gear, with the planet disc rotatably supporting at least one planet gear; the planet gear engaging with a main crank gear; and the main crank gear being mounted in a fixed manner about the output shaft of the speed reducing device by a center axial hole through the main crank gear and a key. A grip for the planet disc is positioned on the stand of the pumping assembly directly or by means of an adjusting mechanism. Therefore, the differential phase adjusting mechanism comprises a gear system having a fixed axis, wherein the speed ratio of the two phase crank gear to the main crank gear is 2.

The semi-automatically adjustable walking beam underset balance mass can be provided in the form of a block or case structure, with the balance mass having a positioning mechanism associated therewith. The balance mass can include a main balance mass and an auxiliary balance mass, which are both of a block or case type structure. The underset balance mass can be slidably mounted to, hinged to, or fixed to the tail end of the walking beam, with the body of the block or case structure being formed from welded steel plates and angle bars, and being filled with a material having significant mass such as waste steel ball, waste steel sand, iron and steel slag, pig iron block, stone or cement. The upper portion of the inner wall of the main balance block or casing constitutes a sliding path, and the auxiliary balance block is connected to a positioning mechanism and is mounted on angle bars fixed to the surface of the sliding path or slidably fitted with the main balance block. The main balance block is provided with a positioning mechanism and is fixed to, slidably fitted on, or hinged to the walking beam. The main balance block can be hung from the walking beam by means of two hanging rods having identical lengths, or it can be hung from the walking beam by a guide wheel drawing mechanism.

In all of the embodiments of the present invention, the differential phase adjusting mechanism and the positioning mechanism for the underset balance mass can be adjusted during the operation of the pumping assembly, and can be controlled by a handwheel or a stepping motor with computer controls, thus obtaining the desired optimum balancing effect.

BRIEF DESCRIPTION OF THE DRAWINGS

The invention is better understood by reading the following Detailed Description of the Preferred Embodiments with reference to the accompanying drawing figures, in which like reference numerals refer to like elements throughout, and in which.

DETAILED DESCRIPTION OF THE PREFERRED EMBODIMENTS

Figure 1:
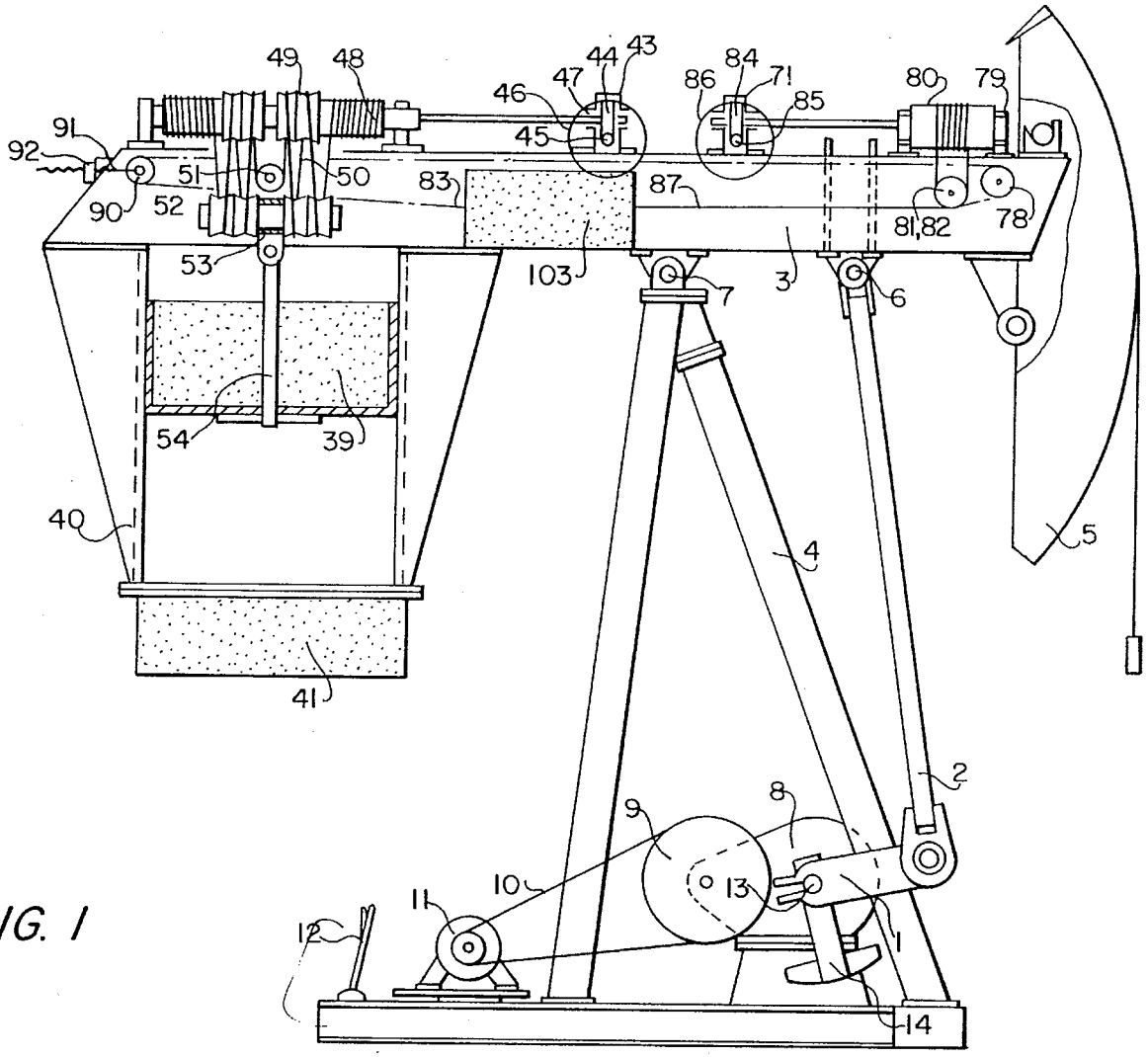
FIG. 1 illustrates a side elevation view of a first embodiment according to the present invention.

In describing preferred embodiments of the present invention illustrated in the drawings, specific terminology is employed for the sake of clarity. However, the invention is not: intended to be limited to the specific terminology so selected, and it is to be understood that each specific element includes all technical equivalents which operate in a similar manner to accomplish a similar purpose.

First Embodiment

Referring to FIG. 1, an embodiment of the present rod pumping assembly having high efficiency and low power consumption, is shown with a power machine 11 being connected via a belt driving device 10 and a speed reducing device 8 to two main cranks 1 that are mounted on two opposite ends of an output shaft 13 of the speed reducing device.

The main cranks 1 via a connecting rod 2 drive a walking beam 3 and a horse head 5 mounted on the front end of the walking beam 3 such that as main cranks 1 are rotated, horse head 5 oscillates up and down. Walking beam 3 is hinged to stand 4 by means of a beam support or bearing 7, and power machine 11 and speed reducing device 8 are fixed to a base of stand 4.

Figure 2:
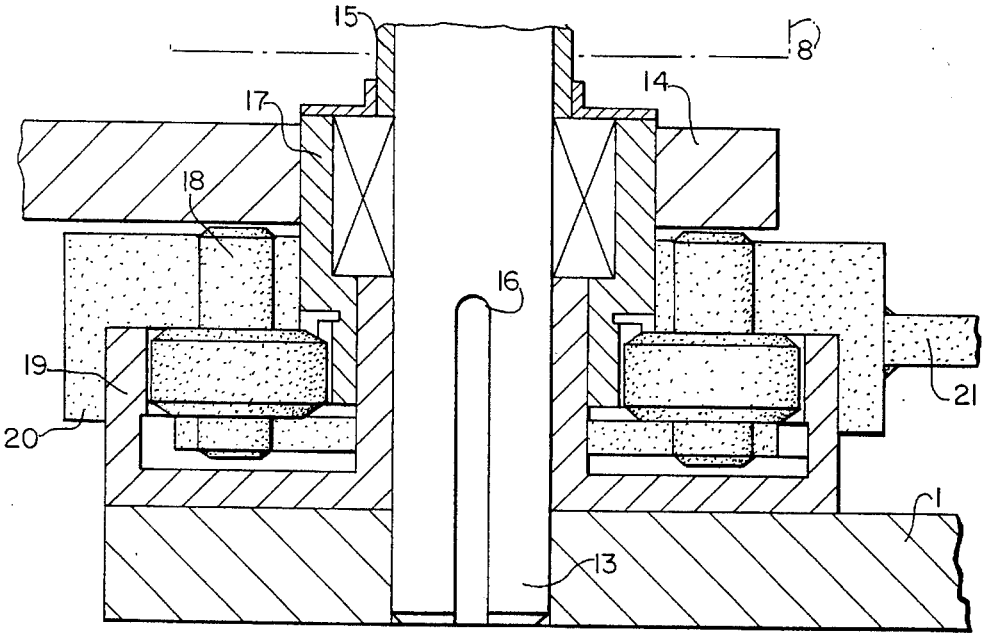
FIG. 2 illustrates a sectional view of a differential phase adjusting mechanism.

In this embodiment of the invention, a two phase crank balance device is provided wherein connection of the two phase crank 14 and main crank 1 is provided with a differential phase adjusting mechanism. Referring to FIG. 2, a two phase crank gear 17 fixedly connected to the two phase crank 14 is mounted rotatably around output shaft 13 of the speed reducing device 8. A planet disc 20 surrounds the outer cylindrical surface of the two phase crank gear 17 and supports one or more planet gears 18 that are rotatably mounted in holes through the planet disc 20. Planet gears 18 are engaged with a main crank gear 19, which may be either an internal gear or an external gear. Main crank gear 19 is mounted in a fixed manner about the output shaft 13 by a center axial hole through main crank gear 19 and a key 15. The outer cylindrical surface of main crank gear 19 fits slidably within a portion of planet disc 20. A grip 21 is connected to planet disc 20 and is mounted relative to the base or stand 4 of the pumping assembly such that it can be moved by means of an adjusting mechanism.

Once the position of the grip 21 is set, the differential phase adjusting mechanism becomes a gear system, having a fixed axis. The ratio of the number of teeth on the two phase crank gear 17 to the number of teeth on main crank gear 19 can be set at 2 such that when main crank gear 19 completes one revolution, two phase crank 14 will complete two revolutions. Furthermore, the phase of the two phase crank 14 can be changed by adjusting the position of grip 21 and therefore planet disc 20, thus regulating the degree of phase shift between two phase crank 14 and main crank 1. Several different embodiments for the differential phase adjusting mechanism can be provided.

Figure 3:
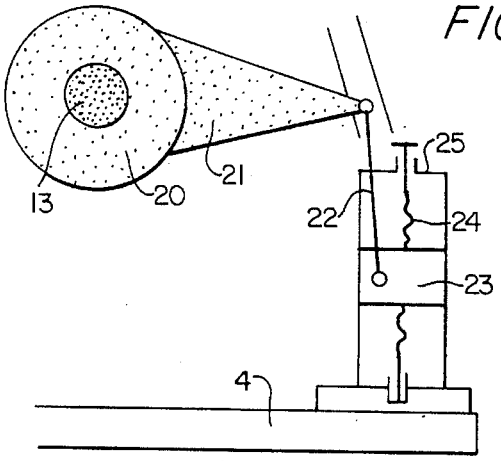
FIG. 3 illustrates a first embodiment of a planet disc adjusting mechanism.

Referring to FIG. 3, the phase adjusting mechanism comprises a screw stem/screw nut slider/rocker mechanism. A support housing 25 having a sliding path and being integrally formed with stand 4 of the pumping assembly rotatably mounts a coaxial screw stem 24. A screw nut 23 threadedly engaged with screw stem 24 is fitted in a sliding manner with the sliding path of support housing 25. A connecting rod 22 is hinged with screw nut 23 at one end and hinged with planet disc grip 21 at the other end. Rotation of screw stem 24 causes screw nut 23 to move up and down and to drive planet disc grip 21 and hence planet disc 20, causing planet disc 20 to rotate about output shaft 13 of the speed reducing device 8.

Figure 4:
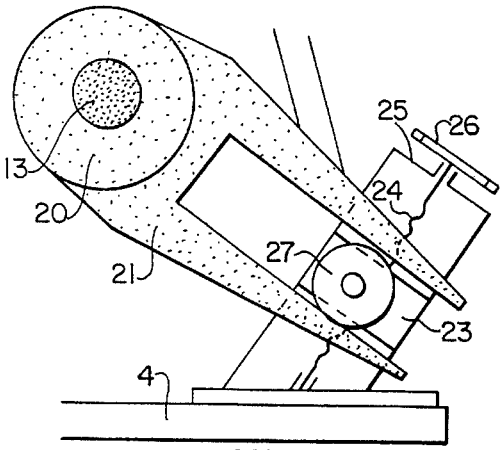
FIG. 4 illustrates a second embodiment of a planet disc adjusting mechanism.

Referring to FIG. 4, the phase adjusting mechanism assumes a different form of a screw stem/screw nut slider/rocker mechanism, in which connecting rod 22 of the previous embodiment is replaced by a contact roller 27 that is rotatably mounted on screw nut slider 23 and that rests in a groove of planet disc grip 21.

Figure 5:
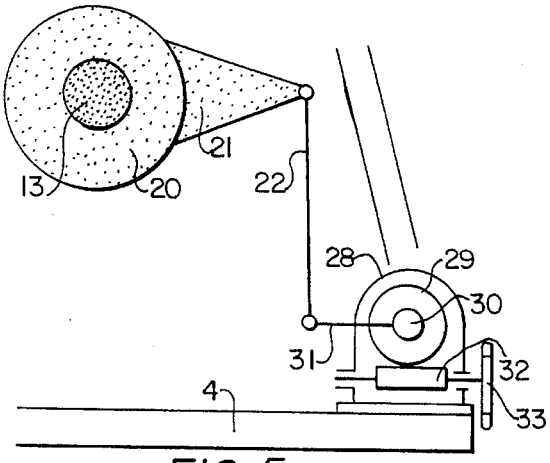
FIG. 5 illustrates a third embodiment of a planet disc adjusting mechanism.

Referring to FIG. 5, the phase adjusting mechanism comprises a speed reducer/double rocker mechanism. A speed reducer, such as a worm gear speed reducer or a planet gear speed reducer 28, having retrograde self-locking properties, is fixed to stand 4 of the pumping assembly by a screw bolt. An output shaft 30 of the speed reducer 28 is connected by a reciprocating arm 31 which is hinged to connecting rod 22 at one end. The other end of connecting rod 22 is hinged to the planet disc grip 21. In this embodiment, connecting rod 22 can also be replaced by a contact roller that rests in a groove of planet disc grip 21.

Figure 6:
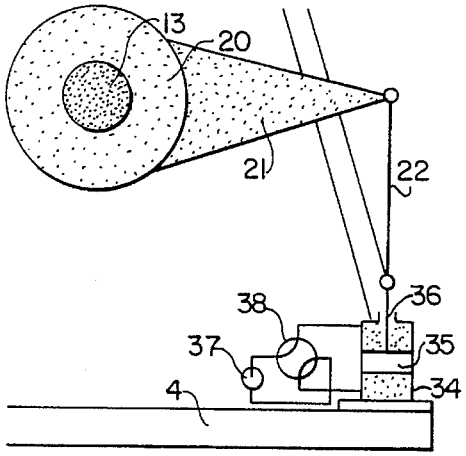
FIG. 6 illustrates a fourth embodiment of a planet disc adjusting mechanism.

Referring to FIG. 6, an embodiment of the adjusting mechanism comprises a liquid pump, liquid cylinder/rocker mechanism. A cylindrical liquid cylinder 34 is fixed to the stand 4 of the pumping assembly. The inside of liquid cylinder 34 is divided by a piston 35 into two liquid cavities. Liquid pump 37 connects the two liquid cavities in series by memos of a three-position four-way valve 38. An extension of piston rod 36 fixed to piston 35 is hinged with a connecting rod 22, which is hinged to planet disc grip 21 at the opposite end. The extension of piston rod 36 can also be hinged with a contact roller that rests in a groove of planet disc grip 21. The three-position, four-way valve 38 can be activated to one of three positions. In a first position, the liquid and the lower cavity of liquid cylinder 34 is pumped into the upper cavity of liquid cylinder 34 by liquid pump 37, hence driving piston 35 downwardly and rotating planet disc grip 21 in a counterclockwise direction. In a second position, the liquid in the upper cavity of liquid cylinder 34 is pumped into the lower cavity by liquid pump 37 and piston 35 is moved upwardly to drive planet disc grip 21 in a clockwise direction. In a third position, the upper and lower cavities are sealed off from contact with each other and both piston 35 and planet disc grip 21 remain stationary.

Since the cross sectional areas of the upper and lower cavities are different (the difference equals the cross sectional area of the piston rod 36), a casing for regulating liquid pressure can be connected to the upper cavity of the cylindrical liquid cylinder 34. The pressure regulating casing is connected to the upper cavity of the liquid cylinder by means of two check valves that arc arranged in parallel. One of the two check valves is a check valve for supplementing liquid which has a lower pressure and can supplement the necessary liquid from the liquid case at any time. The other check valve is a check valve for discharging liquid which will discharge the liquid into the pressure regulating casing only when the pressure in the upper cavity reaches a predetermined pressure.

In one embodiment, the underset balance mass comprises a main balance case 41 that is fixed to walking beam 3 and an auxiliary balance case 39 that slides in the main balance case. More specifically, two balance frames 40 having the form of opposite inverted trapezoids, are integrally formed with walking beam 3. The lower portions of balance frames 40 are fixed to main balance case 41 in order to form a main balance case having a sliding path. Auxiliary balance case 39 is slidably fitted between the sliding path surfaces of balance frame 40.

The positioning device for the underset balance mass is a hoisting device, i.e., a hook, pulley set, reel device. A fixed pulley 49 is rotatably supported on a reel shaft that is formed integrally with two reels 48 (one rotating counterclockwise and other rotating clockwise) located at both ends thereof and supported on walking beam 3 by means of a bearing seat. The reel shaft is connected to art output shaft of a speed reducer, such as a worm gear speed reducer or a planet gear speed reducer 43, having retrograde self-locking properties. Underset auxiliary balance block 39 and main balance block 41 are suspended below reels 48 by means of a rod or wire 54 that is connected to a sleeve 53 on a movable pulley 52, with steel cable 50 passing around a balance pulley 51 located between reels 48 and movable pulley 52, and then around movable pulley 52 and back up around a fixed pulley 49 before returning to reels 48. An input shaft of speed reducer 43 is connected to a hand wheel 46. Rotation of hand wheel 46 causes reel 48 to be driven through speed reducer 43, thus adjusting the position of auxiliary balance block 39 and the main balance block 41. The above described mechanism allows the secondary balancing torque to be adjusted while primary balance torque remains constant.

Second Embodiment

Figure 7:
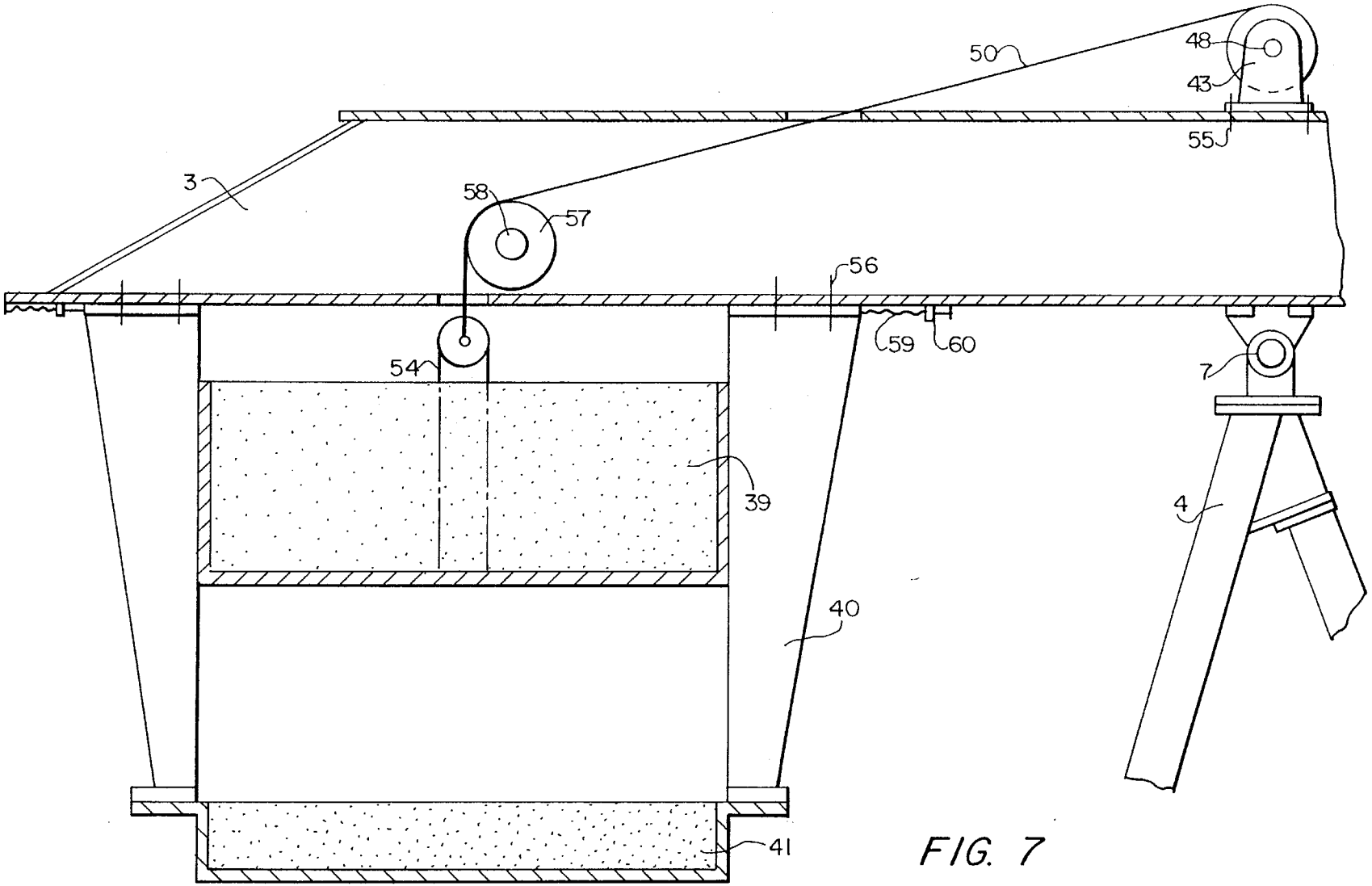
FIG. 7 illustrates a side elevation view of a second embodiment of the positioning mechanism for the underset balance mass according to the present invention.

Referring to FIG. 7, a second embodiment is shown with differences from the first embodiment as follows:

(1) The positioning device of the auxiliary balance block of the first embodiment is replaced with a simpler guide pulley reel device. A rod or wire 54 is connected directly to a rope 50 with the rod 54 supporting the auxiliary balance block. The rope 50 passes over a fixed pulley 57 and then around a reel 48. The shaft of the reel 48 is connected to an output shaft of a speed reducer such as a worm gear speed reducer or a planet gear speed reducer 43 having retrograde self-locking properties.

(2) In this embodiment, the main balance block 41 can be slid along walking beam 3 and positioned by means of a screw stem/screw nut mechanism. A screw nut 60 is formed integrally with walking beam 3 and a threaded rod 59 running parallel to walking beam 3 is threadedly engaged with screw nut 60 and abuts against a side face of the main balance block 41. A similar screw nut/threaded rod combination can be provided on the opposite side of the main balance block 41.

Third Embodiment

Figure 8:
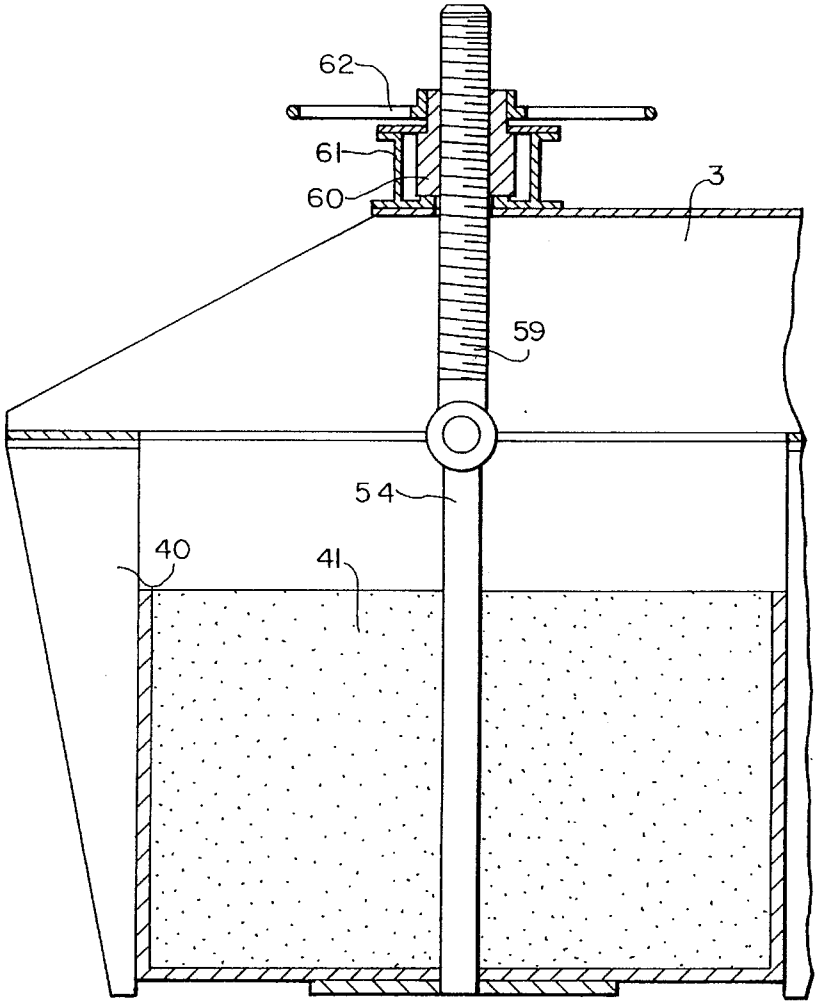
FIG. 8 illustrates a side elevation view of a third embodiment of the positioning mechanism for the underset balance mass according to the present invention.

Referring to FIG. 8, a third embodiment of the present invention is shown that differs from the first embodiment as follows: the underset balance mass consists only of a main balance block 41 with auxiliary balance block 39 being deleted. The positioning mechanism for main balance block 41 is a screw stem/screw nut mechanism. A screw nut 60 is rotatably supported on walking beam 3 by means of a supporting seat 61. A screw stem 59 passes through screw nut 60 and is connected to the main balance block 41. The upper portion of screw nut 60 is connected to a hand wheel 62. When screw nut 60 is revolved about its axis, main balance block 41 is driven to move up and down in the vertical sliding path created by balance frame 40 extending below the walking beam 3. This sliding path may be disposed perpendicular to walking beam 3 or at an acute, or obtuse angle to walking beam 3.

Fourth Embodiment

Figure 9:
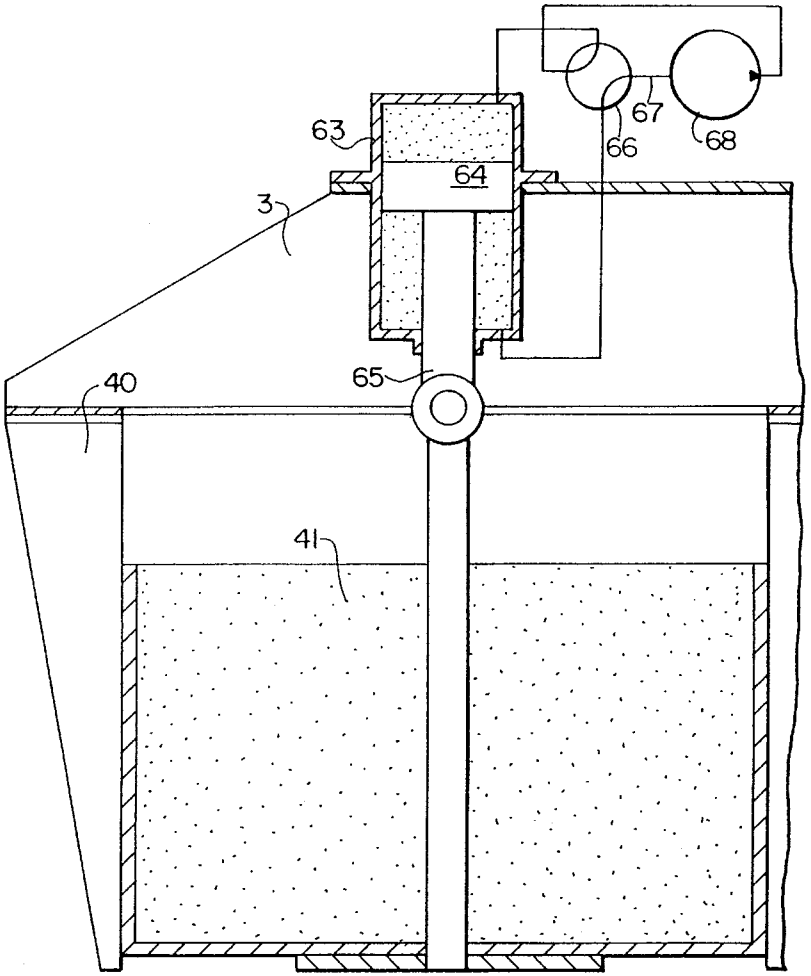
FIG. 9 illustrates a side elevation view of a fourth embodiment of the positioning mechanism for the underset balance mass according to the present invention.
Figure 12:
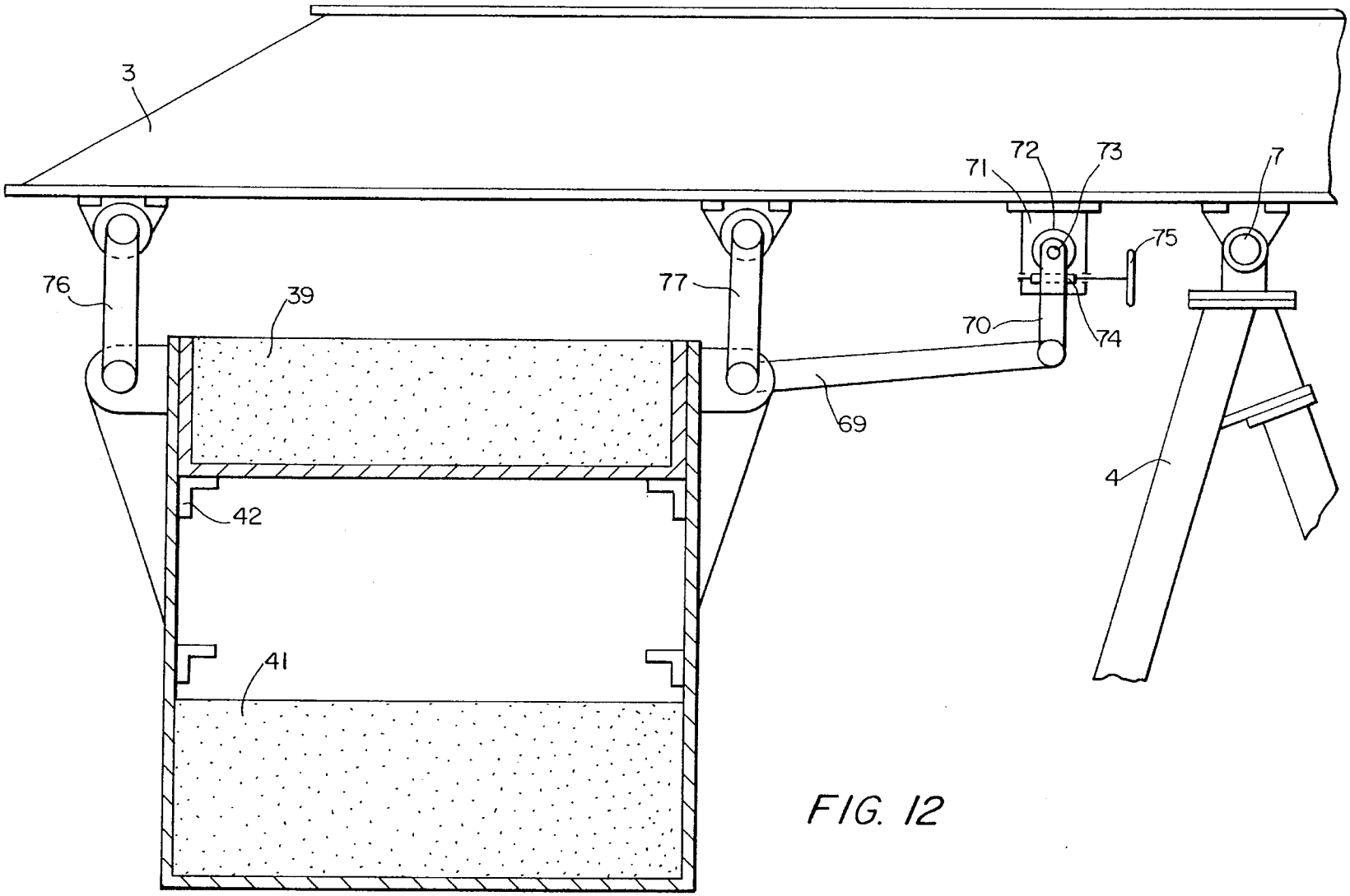
FIG. 12 illustrates a side elevation view of a seventh embodiment of the positioning mechanism for the underset balance mass according to the present invention.

Referring to FIG. 9, the fourth embodiment differs from the third embodiment as follows: The positioning mechanism of the main balance block 41 is replaced with a liquid pump/liquid cylinder/connecting rod mechanism. A liquid cylinder 63 is divided into two liquid cavities by a cylinder piston 64. A liquid pump 68 connects the two liquid cavities in series by means of a three-position, four-way valve 66 and liquid conduit 67. An extension of piston rod 65 fixed to piston 64 is connected to the main balance block 41. The sliding path of the underset balance mass is determined by frame 40 which again can extend from the lower side of walking beam 3 at a right angle or a slant to walking beam 3. Alternatively, main balance block 41 could also be hinged to walking beam 3 by means of hanging rods 76, 77 (as shown in FIG. 12) having identical lengths. With such an alternative arrangement, the positioning device would include a connecting rod 69 hinged to piston rod 65 at one end and connected to the main balance block 41 at the opposite end.

Fifth Embodiment

Figure 10:
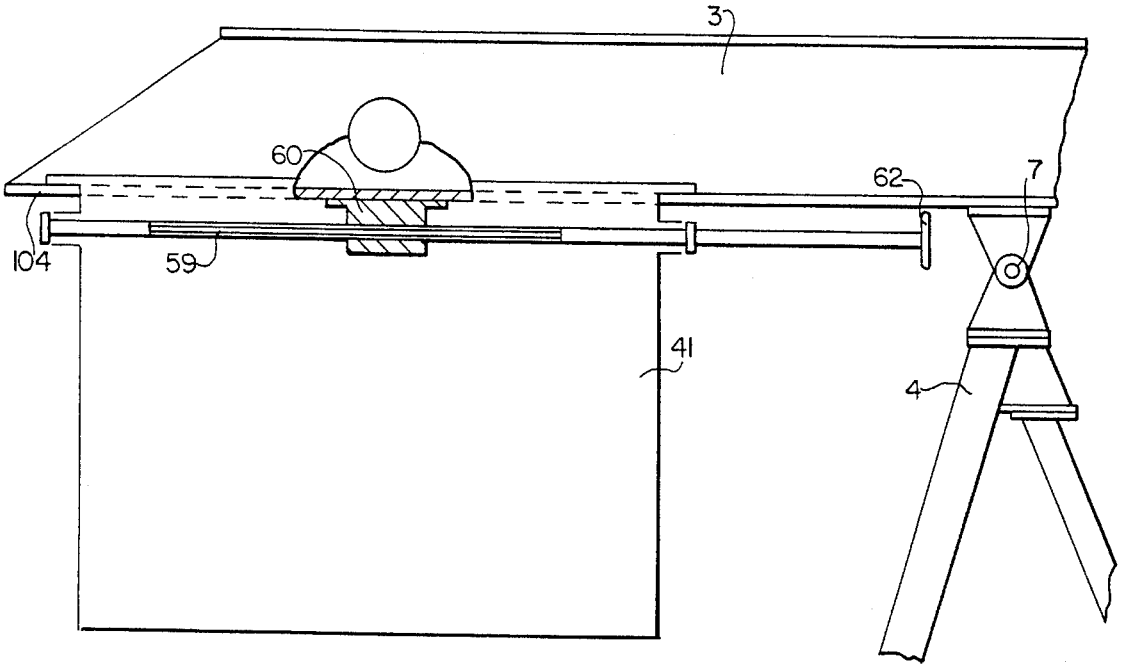
FIG. 10 illustrates a side elevation view of a fifth embodiment of the positioning mechanism for the underset balance mass according to the present invention.

Referring to FIG. 10, a fifth embodiment is shown that differs from a third embodiment shown in FIG. 8 in that the sliding path for main balance block 41 is disposed in parallel to walking beam 3 and along a lower edge 104 of walking beam 3. A screw stem/screw nut positioning mechanism is used with a screw nut 60 being fixed to the underside of walking beam 3 and a screw stem 59 threadedly engaged with screw nut 60 and being hinged to the main balance block 41 by means of two supports at the ends of screw stem 59.

Sixth Embodiment

Figure 11:
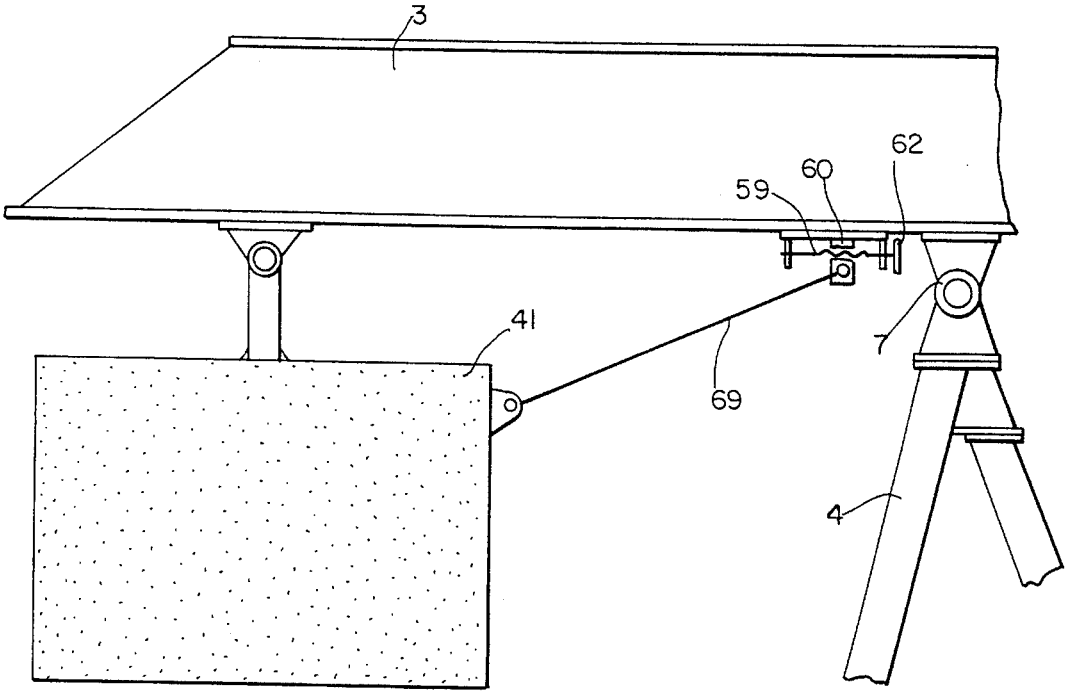
FIG. 11 illustrates a side elevation view of a sixth embodiment of the positioning mechanism for the underset balance mass according to the present invention.

Referring to FIG. 11, a sixth embodiment is shown that differs from the second embodiment as follows:

1) the main balance block 41 is hinged to walking beam 3 by means of a bearing seat.

2) A screw stem screw nut positioning mechanism is supported below walking beam 3 with screw nut 60 being slidably mounted below walking beam 3 such that as screw stein 59 is rotated, screw nut 60 moves axially along walking beam 3 and through a connecting rod 69 moves main balance block 41. Alternatively, main balance block 41 can be hung from walking beam 3 by two hanging rods 76, 77 as shown in FIG. 12 having identical lengths. Connecting rod 69 can be pivotally connected to screw nut 60 at one end and to main block 41 at the other end, or can be fixedly connected at both ends, or can be pivotally connected at one end and fixed at the other end. Furthermore, screw nut 60 can be fixedly connected to walking beam 3 with main balance block 41 being slidably supported below walking beam 3.

The positioning mechanism of the sixth embodiment can also include a double screw stem/screw nut mechanism having two screw rods 59 (one being left-hand threaded and the other being right-hand threaded) which are rotatably mounted to the underside of walking beam 3 and to main balance block 41 respectively. A screw nut, having left-hand threads at one end and right-hand threads at the other end, can connect the two screw rods 59 together.

Seventh Embodiment

Referring to FIG. 12, a seventh embodiment of a balance mass adjusting mechanism comprises a main balance block 41 being hung from the underside of walking beam 3 by two identical rods 76 and 77, which are hinged at one end to walking beam 3 and at the other end to the main balance block 41, and an auxiliary balance block 39 supported on angle bars that allow for the adjustment of the position of auxiliary balance block 39 relative to main balance block 41. The positioning mechanism of the seventh embodiment includes a speed reducer/crank mechanism. The speed reducer preferably has retrograde self-locking properties, such as with a worm gear speed reducer or a planet gear speed reducer. The output shaft 73 of speed reducer 71 is fixed to a crank 70. A connecting rod 69 is pivotally connected to crank 70 at one end and at the other end to the main balance block 41. The main balance block 41 can be adjusted relative to walking beam 3 by operating hand wheel 75 fitted on the input shaft of speed reducer 71 thins moving main balance block 41 by means of speed reducer 71, crank 70 and connecting rod 69.

Eighth Embodiment

Figure 13:
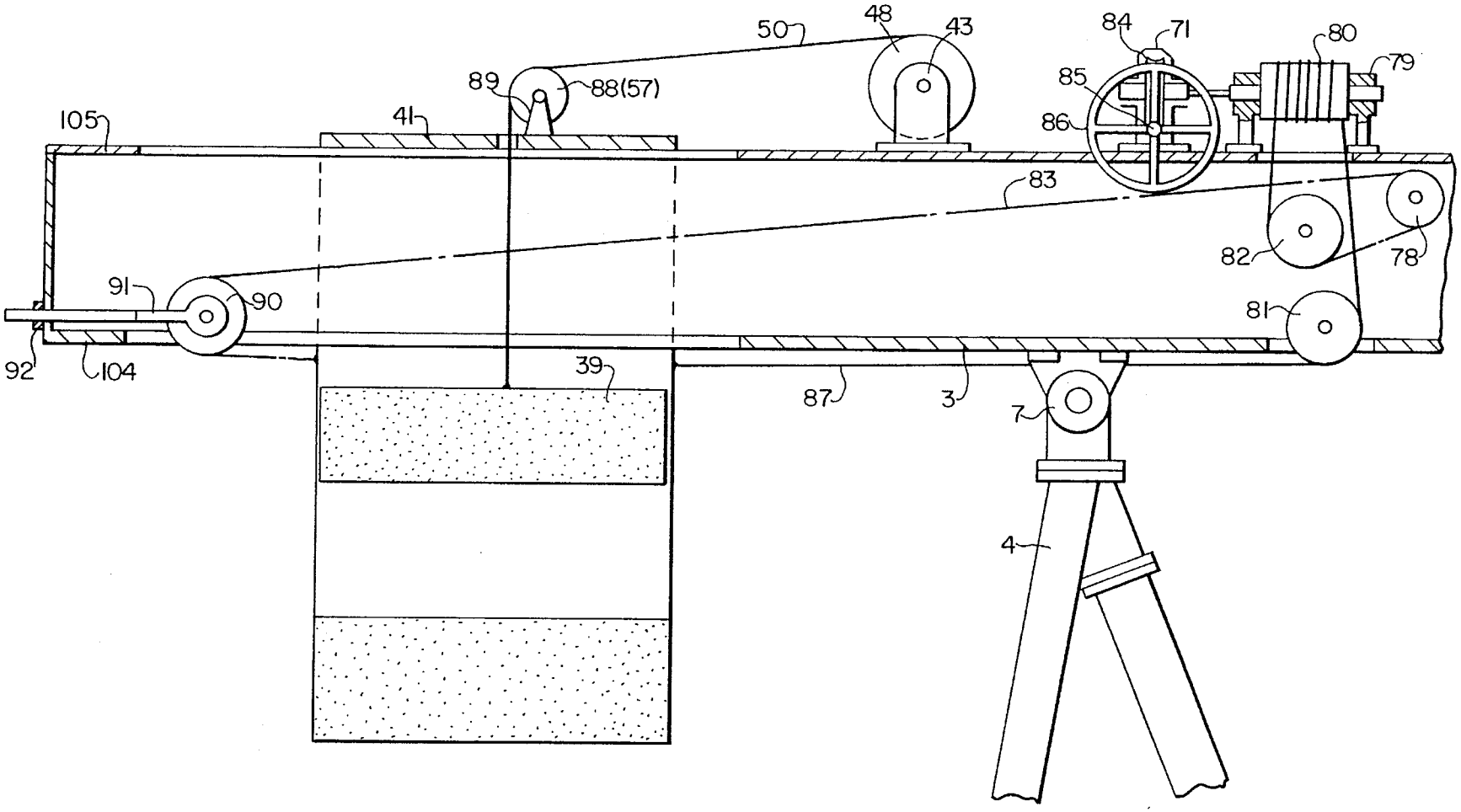
FIG. 13 illustrates a side elevation view of a eighth embodiment of the positioning mechanism for the underset balance mass according to the present invention.

Referring to FIG. 13, the eighth embodiment is characterized by the main balance block being slidably fitted through walking beam 3 with the sliding path defined on upper surface 105 of walking beam 3. The positioning mechanism of the main balance block 41 includes a speed reducer of a reel and pulley type mechanism. A speed reducer 71 having retrograde self-locking properties and a reel 80 are fixed to the upper surface of walking beam 3. The output shaft of speed reducer 71 is connected to the shaft of the reel 80 by means of a shaft coupling. Steel cable 87 is wound around the right-hand side of reel 80 and then passes around a guiding pulley 81 hinged on walking beam 3, and then connects to the right side of the main balance block 41. A steel cable 83 winds around the left-hand side of reel 80 and then passes around a guiding pulley 82, and then around a right guiding pulley 78 that is hinged to walking beam 3 and then around a tightening pulley 90 that is hinged to the tail end of walking beam 3, and then connects to the left side of the main balance block 41. The mandrel of tightening pulley 90 is fitted into the bore of an annular headed screw stem 91. Screw stem 91 passes through a hole formed on an endplate of walking beam 3 at its tail end and is threadedly engaged with a tightening screw nut 92. The main balance block 41 is moved along walking beam 3 by steel cables 87 and 83 leading out from reel 80. Operating a handwheel 86 connected with the input shaft of speed reducer 71 causes reel 80 to be driven at a reduced speed. One of the two strands of steel cable leading out from reel 80 loosens and the other tightens while turning handwheel 86, thus driving main balance block 41 to move along the sliding path of walking beam 3 and, when rotation of handwheel 86 is stopped, to retain main balance block 41 in a fixed position on walking beam 3. In this embodiment, the main balance block 41 can alternatively be guided along a sliding path that is oriented in a vertical direction or an oblique direction relative to walking beam 3.

In the first embodiment, shown in FIG. 1, the positioning mechanism for the conventional walking beam balance block 103 is provided in the internal cavity of walking beam 3 and is a reel-pulley type mechanism identical to that of this eighth embodiment. Therefore, the position of the conventional bema balance block 103 in FIG. 1 can be adjusted while the pumping assembly is in a non-stopped status, thus providing a means for an effective auxiliary balance mechanism.

Ninth Embodiment

Figure 14:
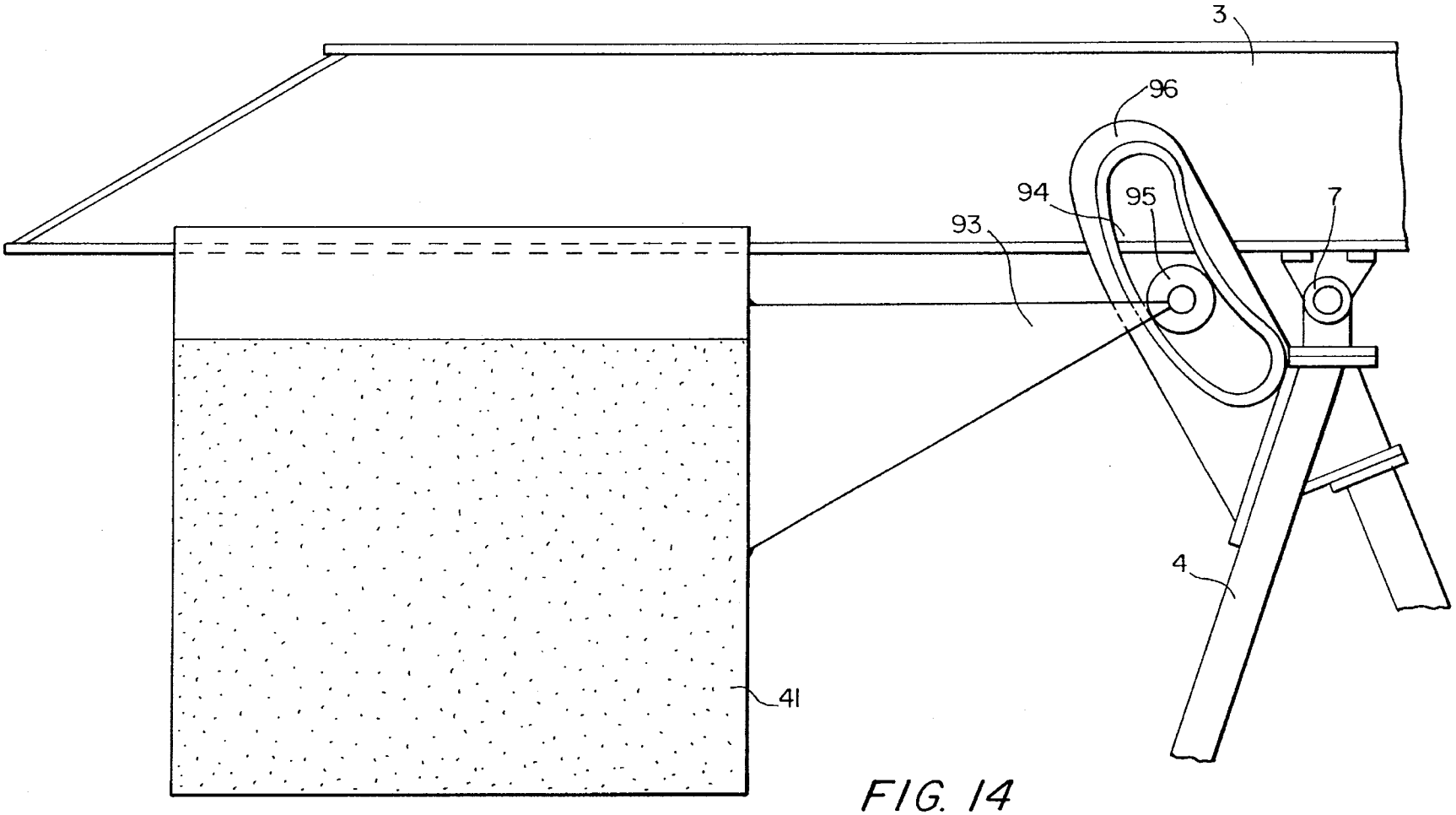
FIG. 14 illustrates a side elevation view of a ninth embodiment of the positioning mechanism for the underset balance mass according to the present invention.

Referring to FIG. 14, a ninth embodiment of the present invention comprises a main balance block 41 being slidably fitted with walking beam 3 (or, alternatively hinged, or hung from walking beam 3 with two hanging rods having the same lengths). The main balance block 41 is provided with a semi-automatic positioning mechanism including a cam controlling plate mechanism. The cam controlling plate 96 is fixed to the stand 4 of the pumping assembly. A connecting plate 93 is fixed at one side to the main balance block 41, and at the other side rotatably supports a cam follower or roller 95 held in a cam groove 94 of cam controlling plate 93. The cam groove 94 of cam controlling plate 93 may have various shapes, and therefore may be designed to the optimum shape according to the working conditions of the oil field, thus controlling the position of the main balance block 41 in order to adapt to the optimum pattern for achieving the best balance effect.

Tenth Embodiment

Figure 15:
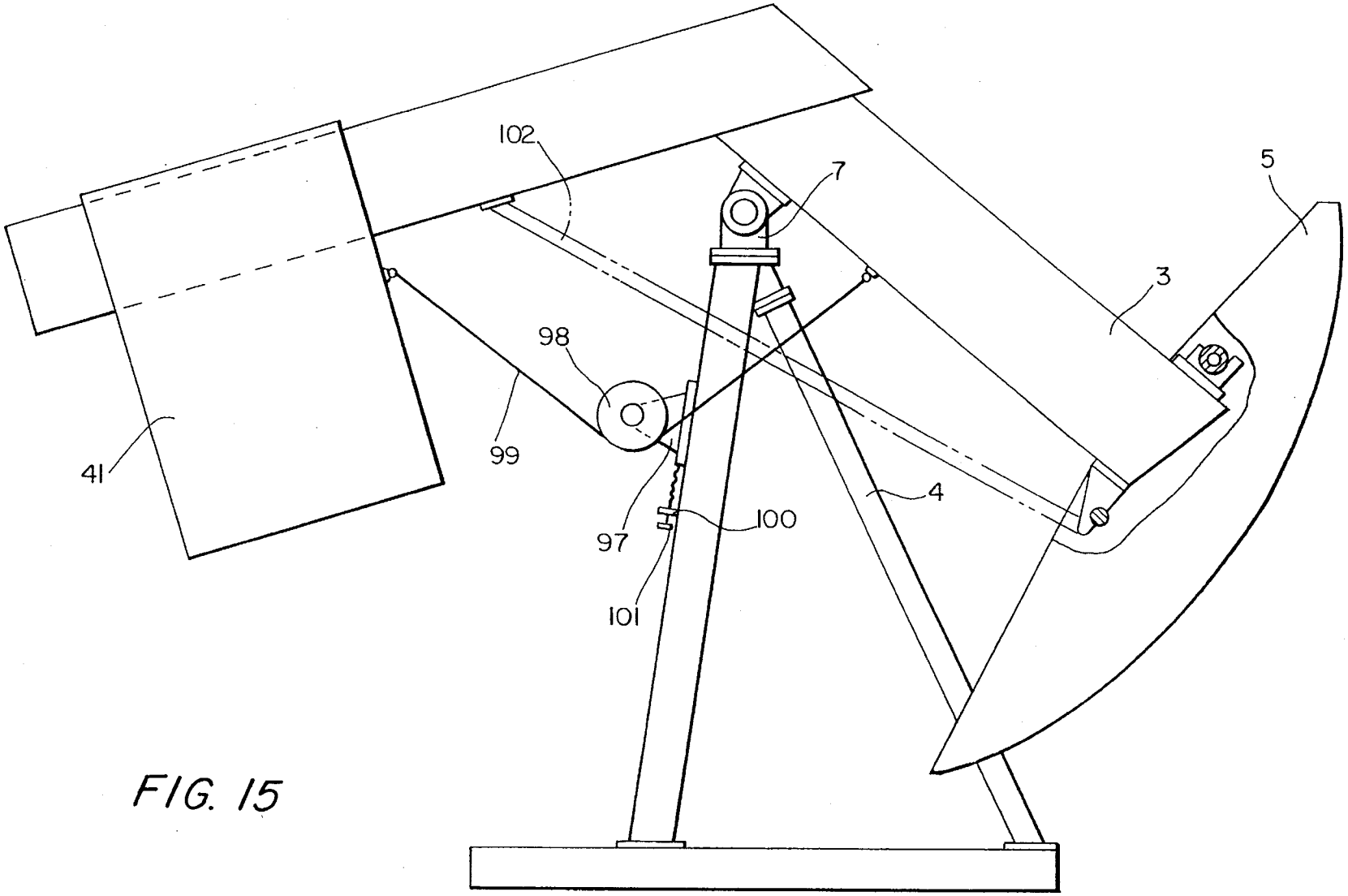
FIG. 15 illustrates a side elevation view of a tenth embodiment of the positioning mechanism for the underset balance mass according to the present invention.

Referring to FIG. 15, the tenth embodiment comprises a rope (steel cable, belt or chain) 99 that is connected at one end to walking beam 3 and at the other end to main balance block 41. Rope 99 passes around a tightening wheel (pulley) 98 that is mounted to stand 4 of the pumping assembly. Since the total length of rope 99 is constant, the length of rope 99 on opposite sides of pulley 98 will vary as the walking beam is pivoted about its mounting point on stand 4. This forces main balance block 41 to change its position relative to walking beam 3, and the amount of such change can be controlled by regulating the length of rope 99, the positions at which the rope 99 is connected to the walking beam and to the main balance block 41, and the position of pulley 98 on stand 4. The position of pulley 98 may also be controlled by an adjusting mechanism that can be operated when the pumping station is in a non-stop status.

Another feature of this embodiment is that walking beam 3 is a bent beam with a load absorbing brace 102 connected between the two ends of bent beam 3 by a screw bolt. This type of bent walking beam has the advantage of decreasing the weight and rotational inertia of the walking beam, and when a conventional beam balance block 103 is provided on the internal cavity of the walking beam, the walking beam center of gravity is lowered, thus improving the balance effect greatly.

Eleventh Embodiment

Figure 16:
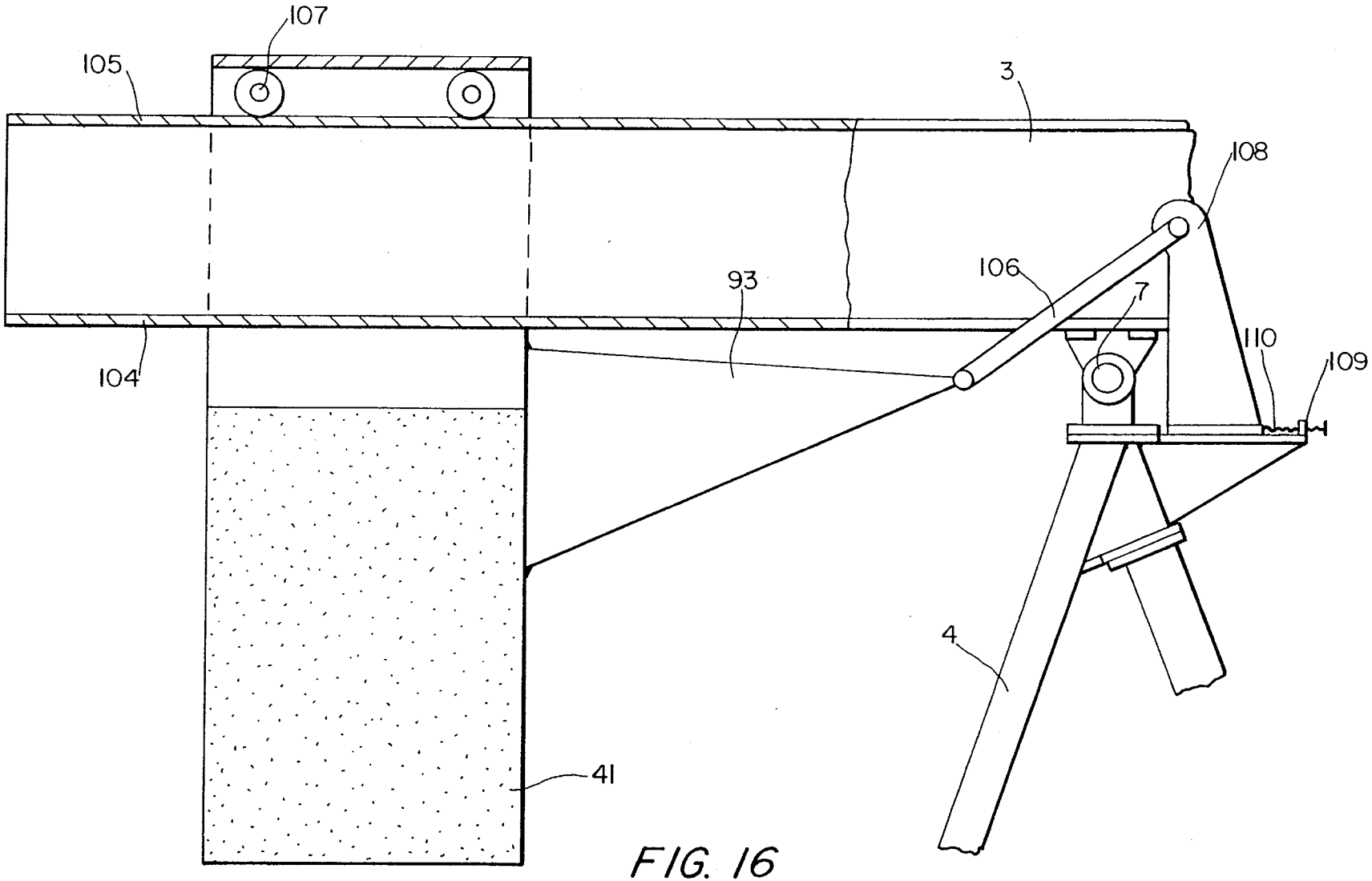
FIG. 16 illustrates a side elevation view of a eleventh embodiment of the positioning mechanism for the underset balance mass according to the present invention.

Referring to FIG. 16, an eleventh embodiment of the present invention comprises a rigid pole rod 106 that is provided to replace the cam controlling plate 96 of the embodiment shown in FIG. 14. One end of the pole rod is hinged to the main balance block 41 directly or through a connecting plate 93 formed integrally with the main balance block 41. The other end of the pole rod 106 is hinged to a supporting seat 108 fixed on stand 4 of the pumping assembly. The length of pole rod 106 can be selected in order to approximately equal the radius of the arc of cam groove 94 in cam controlling plate 96 as illustrated in FIG. 14. The center of the supporting seat 108 coincides with the center of this arc. The function of this mechanism is similar to that of the cam controlling mechanism shown in the ninth embodiment (FIG. 14). The position of supporting seat 108 can be adjusted by a screw stem/screw nut positioning mechanism in order to optimize the balancing effect. The positioning screw nut 109 is fixed on stand 4 of the pumping assembly, The positioning screw stem rests against or hooks into supporting seat 108. Alternatively, the screw stem/screw nut positioning mechanism of the twelfth embodiment could be used in connection with supporting seat 108.

Main balance block 41 is suspended from walking beam 3. The sliding path for main balance block 41 can be the top surface 105 of walking beam 3 or the bottom surface 104 of walking beam 3. Wheels 107 provide a near frictionless connection between main balance block 41 and walking beam 3. Such a wheel rolling structure can be used in all of the embodiments of the present invention where the main balance block, the auxiliary balance block or the conventional beam balance block are mounted slidably with respect to walking beam 3.

Twelfth Embodiment

Figure 17:
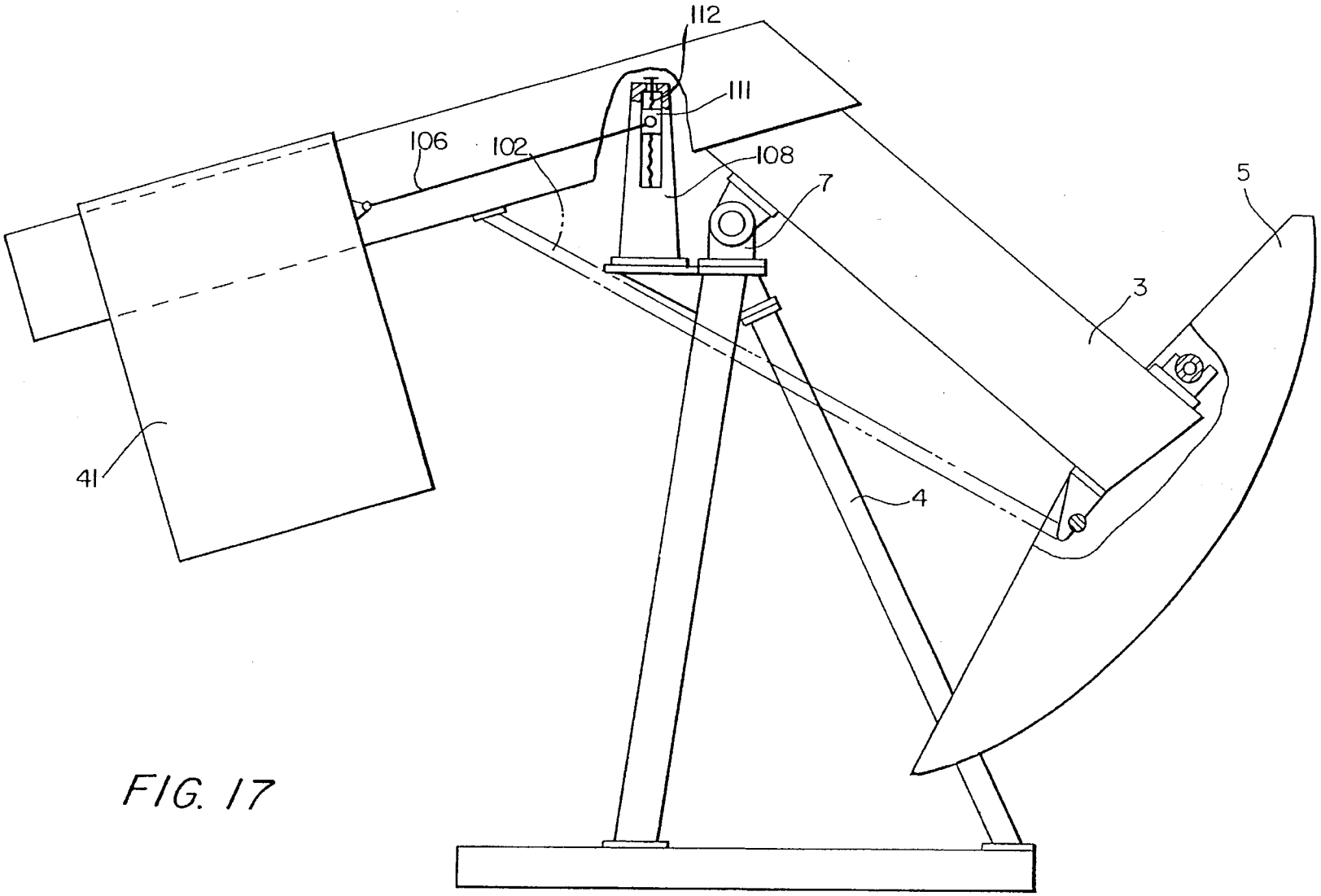
FIG. 17 illustrates a side elevation view of a twelfth embodiment of the positioning mechanism for the underset balance mass according to the present invention.

Referring to FIG. 17, a twelfth embodiment of the present invention comprises a bent walking beam 3, and a flexible pole rod 106, that can be constructed from steel cable, a steel belt or a chain. A supporting seat 108 is fixed to stand 4 of the pumping unit and is provided with a screw stem/screw nut type positioning mechanism. The supporting seat 108 includes a sliding groove in which a screw nut sliding block 111 is threadedly engaged with a positioning screw stem 112. Screw nut sliding block 111 is hinged with flexible pole rod 106 at one end, with the other end of flexible pole rod 106 being hinged to the main balance block 41. Alternatively, the positioning mechanism could be replaced with a screw stem/screw nut positioning mechanism such as used in the eleventh embodiment.

Thirteenth Embodiment

Figure 18:
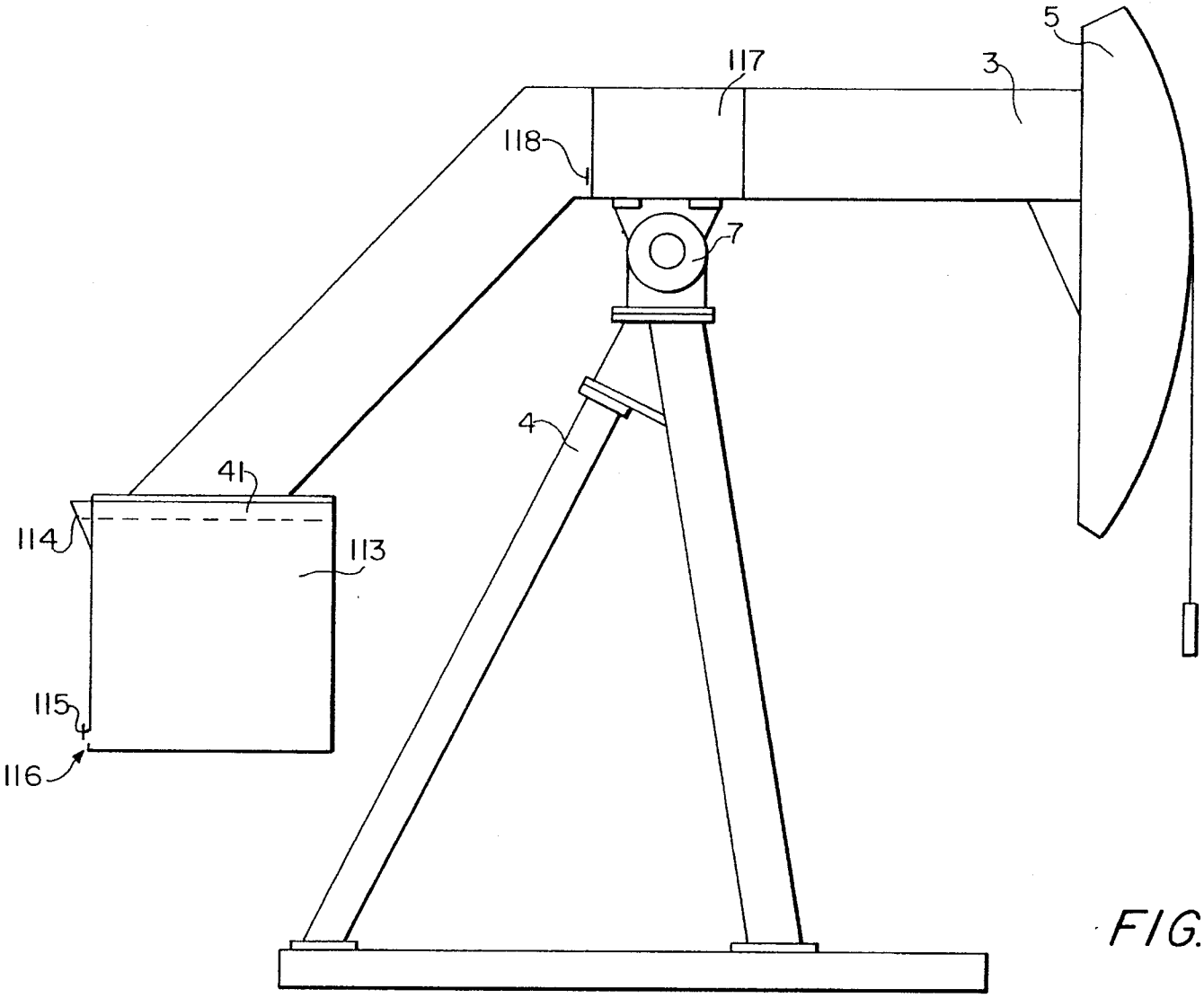
FIG. 18 illustrates a side elevation view of a thirteenth embodiment of the positioning mechanism for the underset balance mass according to the present invention.

Referring to FIG. 18, a thirteenth embodiment of the present invention comprises a bent walking beam 3 in which a main balance block 41 having the shape of a cylindrical block is fixed to the tail end of bent walking beam 3. The main balance block 41 can be filled with sand and has a fill opening 114 at the upper portion and a discharge opening 116 at its lower portion. The optimum balance state for this embodiment can be achieved by adjusting the balance mass as results of supplying sand through opening 114 or discharging sand through discharge opening 116.

A sand reservoir positioning mechanism can also be provided with this embodiment. A sand reservoir 117, filled with sand, is provided at the middle portion of the walking beam 3 with the mass center of the sand being located very near the supporting center of the walking beam, thus having little effect on the balance of walking beam 3. The lower portion of sand reservoir 117 has a sand discharge opening controlled by a sand discharge opening valve 118 which directs the sand to main balance block 41. Sand discharge opening valve 118 of the sand reservoir and sand discharge opening valve 115 of the main balance block 41 can be controlled by a relay to adjust the balance state of the pumping unit while in a non-stop status through the use of a motor and a computer.

Fourteenth Embodiment

Figure 19:
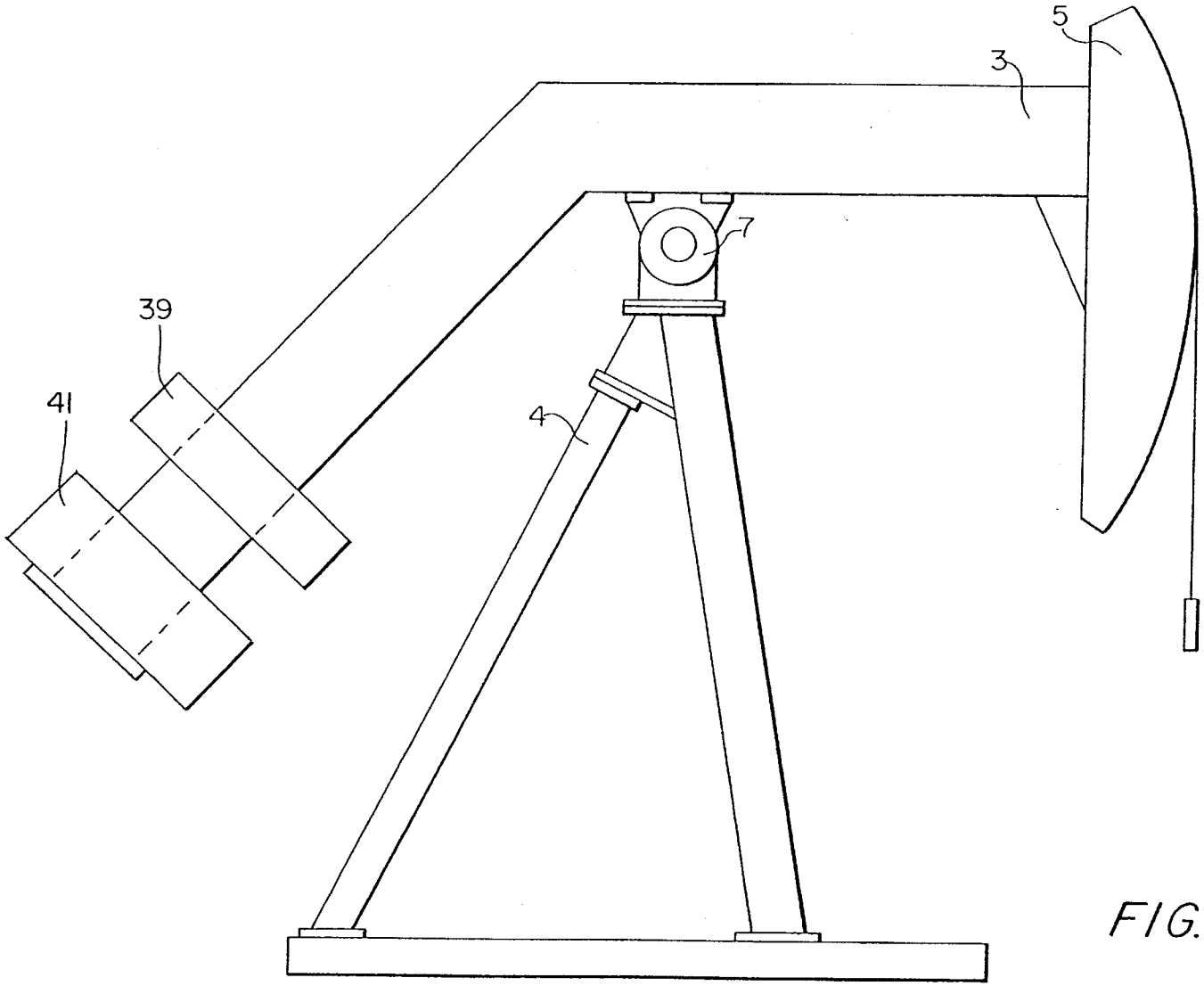
FIG. 19 illustrates a side elevation view of a fourteenth embodiment of the positioning mechanism for the underset balance mass according to the present invention.

Referring to FIG. 19, a fourteenth embodiment of the present invention comprises a main balance block that surrounds the tail end of walking beam 3 and an auxiliary balance block 39 that surrounds the tail end of walking beam 3 and can be slidably moved along walking beam 3 through the use of a positioning mechanism such as described in any of the previous embodiments.

Fifteenth Embodiment

Figure 20:
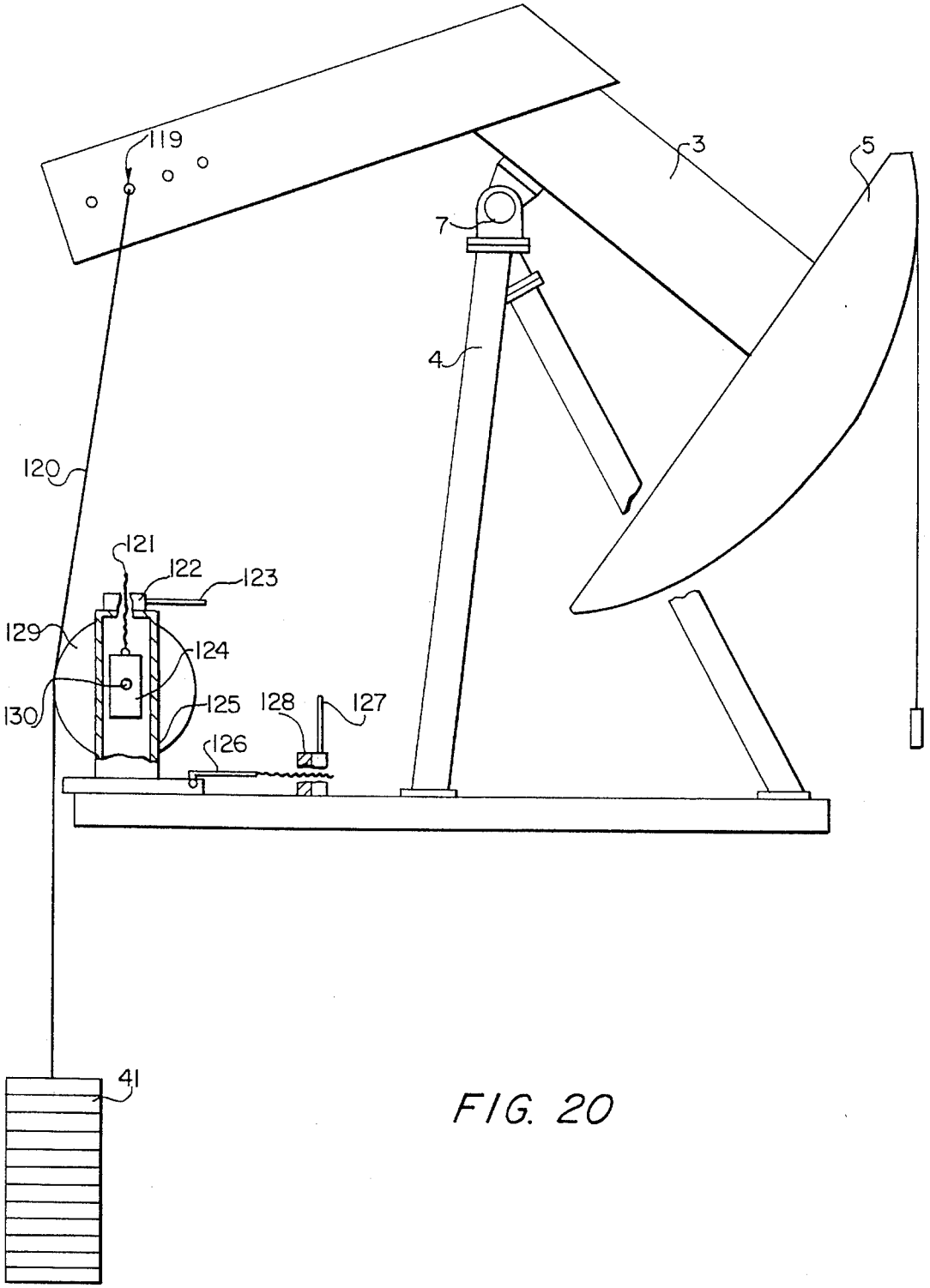
FIG. 20 illustrates a side elevation view of a fifteenth embodiment of the positioning mechanism for the underset balance mass according to the present invention.

Referring to FIG. 20, a fifteenth embodiment of the present invention comprises a walking beam pumping unit in which the main balance block 41 is connected to walking beam 3 by means of a guide wheel drawing mechanism. A guide wheel positioning seat 125 is slidably mounted at the tail end of the base of the stand 4. Seat 125 is formed with a vertical sliding path in which a guide wheel sliding seat 124 is slidably fitted with guide wheel positioning seat 125. Guide wheel sliding seat 124 is formed with an axle hole rotatably supporting an axle of guide wheel 129 (or alternatively two wheels connected by a rope 120 between the two wheels with a connecting line of the centers of the two wheels being horizontal). With guide wheel sliding seat 124 positioned in guide wheel positioning seat 125 and guide wheel positioning seat 125 being mounted to the base of the pumping unit, the position of guide wheel 129 can be adjusted relative to the base. A rope, steel cable, weaved belt, or chain 120 is connected to a main balance block 41 at its lower end and is connected at its upper end to walking beam 3 by means of a pinhole 119 passing through the tail end of walking beam 3, with rope 120 passing tangentially over guide wheel 129.

In this embodiment of the walking beam pumping assembly, the direction of the force exerted on walking beam 3 by the main balance block 41 changes constantly according to the position of walking beam 3. It can be proved that the balance torque produced by the balance mass 41 in this case has both a primary balancing torque and a secondary balancing torque, thus obtaining optimum balance effect.

In this embodiment, the values of the primary torque and the secondary torque can be increased or decreased by increasing or decreasing the mass of the main balance block 41. The values of the secondary and primary torque and the proportion of secondary torque to primary torque can be changed by means of changing the vertical and horizontal positions of guide wheel 129.

The vertical and horizontal positions of guide wheel 129 can be adjusted by a positioning mechanism that includes a screw stem 121 that is formed integrally with guide wheel sliding seat 124 in a longitudinally positioning screw nut 122 being supported on the top end of guide wheel sliding seat 124. A transversely positioning screw stem mechanism can be provided between the guide wheel positioning seat and the base of the pumping unit. The transversely positioning screw stem mechanism includes a transverse screw stem 126 fixed to the guide wheel positioning seat 125 and a transverse positioning screw nut 127 that abuts against the transverse positioning seat 128 formed integrally with the base of the pumping unit. Rotation of longitudinally positioning screw nut 122 and transversely positioning screw nut 127 results in the longitudinal and transverse positions of the guide wheel 129 being adjusted in order to achieve the optimum balance state. Screw nuts 127 and 122 can be provided with handles in order to allow for manual or powered adjustments.

This embodiment adopts a bent walking beam with a group of pinholes 119 at the tail end in order to allow for further adjustment of the balance torque. Alternatively, a linear walking beam 3 could be used or a structure that combines features from any of the other embodiments could be adopted.

Sixteenth Embodiment

Figure 21:
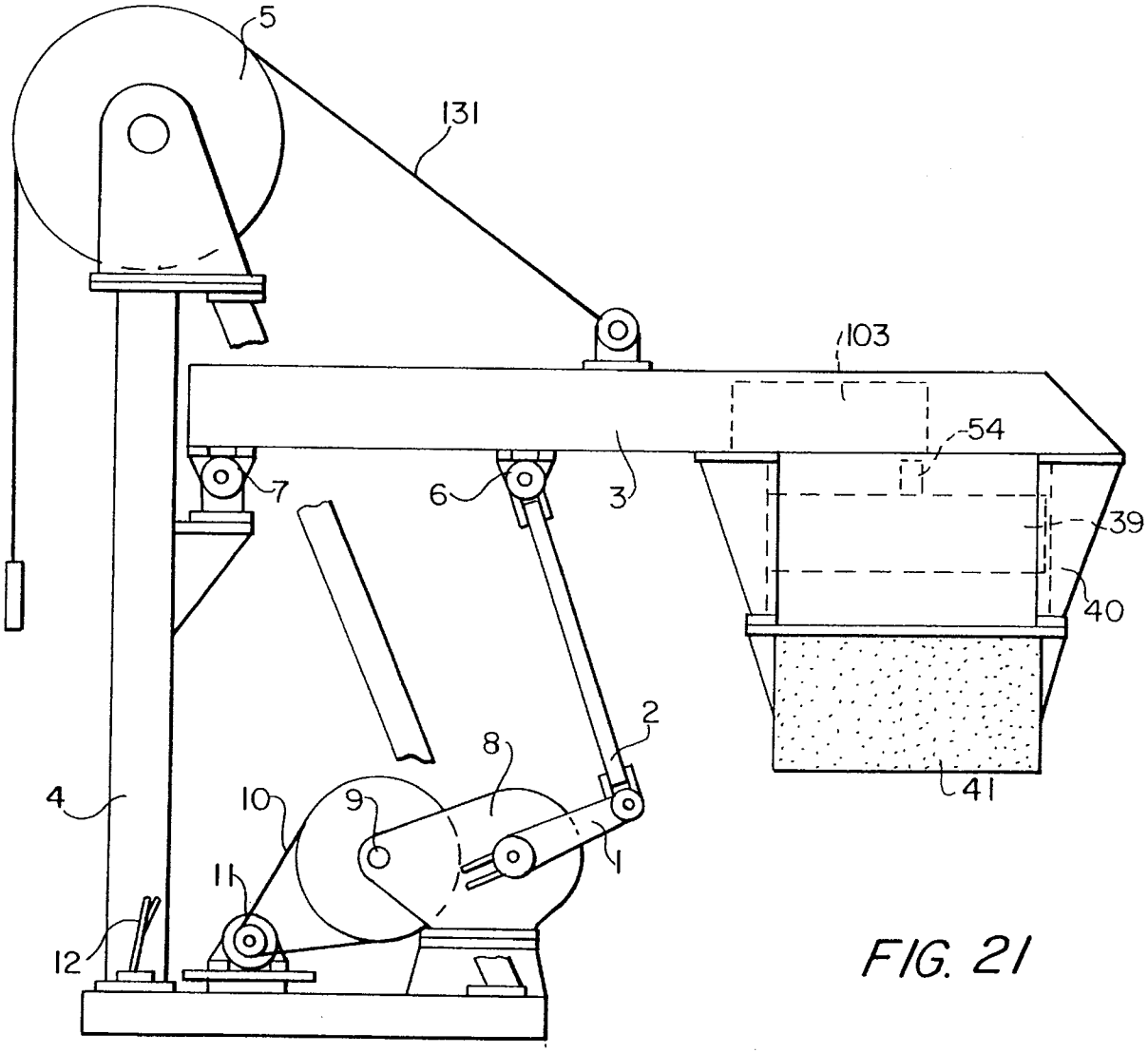
FIG. 21 illustrates a side elevation view of a sixteenth embodiment of the positioning mechanism for the underset balance mass according to the present invention.

Referring to FIG. 21, a sixteenth embodiment of the present invention comprises a walking beam pumping assembly having a rotating horse head (i.e., a wheel horse head). This embodiment differs from the first embodiment of FIG. 1 in that the horse head of FIG. 1 is replaced with a wheel horse head 5 that is rotatably mounted on stand 4 by means of a top support bearing and is connected to walking beam 3 by a rope 131. One end of rope 131 is hinged to walking beam 3, with the other end passing over wheel horse head 5 and being connected to a hanging rope device.

The main and auxiliary balance masses in their positioning mechanisms in this embodiment may utilize features from any of the second to fifteenth embodiments and may be combined with a bent walking beam 3 as described previously.

The main balance block positioning mechanisms of the ninth to twelfth embodiments can be also used for adjusting the position of a conventional beam balance block 103 that is slidably mounted on walking beam 3.

While all of the embodiments described above for the present invention utilize a front driven walking beam pumping assembly, such embodiments could also be used with a back driven walking beam pumping assembly simply by moving the hinge point of connecting rod 2 and walking beam 3 to the tail end of walking beam 3.

The phase adjusting mechanisms and positioning mechanisms in the various embodiments of the present invention can be operated manually by handwheels or alternatively can be powered by a motor, including computer controls if desired.

Modifications and variations of the above-described embodiments of the present invention are possible, as appreciated by those skilled in the art in light of the above teachings.

It is therefore to be understood that, within the scope of the appended claims and their equivalents, the invention may be practiced otherwise than as specifically described.

What is claimed is:

1. A rod pumping assembly used in an oil field, comprising:

a power machine;

a speed reducing means;

said speed reducing means having an output shaft;

a belt driving means for connecting said speed reducing means to said power machine and for driving said speed reducing means by said power machine;

a four-hinge crank-rocker mechanism including a main crank, a connecting rod, a walking beam and a stand, and used to change the rotation of said output shaft of said speed reducing means into an up and down linear movement of a slick rod, wherein said main crank is fixed to the end of said output shaft of said speed reducing means and is fixedly connected with a base formed integrally with said stand;

the walking beam being hinged with a top end of the stand by means of a bearing and being able to swing about an axis of the bearing in a vertical plane;

one end of the connecting rod being hinged with the main crank and the other end of the connecting rod being hinged with the walking beam at a position deviating from the point at which the walking beam is hinged to the stand;

a horse head means connected to a front end of the walking beam for being connected with said slick rod;

a walking beam underset balance mass connected to a rear-end of the walking beam and being semi-automatically adjustable in its position relative to the walking beam; and a two-phase crank secondary balance means being connected with the main crank through a differential phase adjusting means.

2. The rod pumping assembly according to claim 1 wherein:

the differential phase adjusting means comprises a two-phase crank gear integrally formed with a two-phase crank which is rotatably mounted on the output shaft of the speed reducing means, a planet disc being rotatably mounted on an outer cylindrical surface of the two-phase crank gear and engaging with a planet gear rotatably mounted into a hole of the planet disc, said planet gear engaging with a main crank gear, and the main crank gear being mounted in a fixed manner about the output shaft of the speed reducing means by a central axial hole through the main crank gear and a key, and a grip for the planet disc, being fixed to the planet disc and being positioned on the stand of the pumping assembly; the differential phase adjusting means thereby forming a gear system with a fixed axis, wherein a speed ratio of the two-phase crank gear and the main crank gear is 2.

3. A rod pumping assembly according to claim 2, wherein:

the differential phase adjusting mechanism is a speed reducer/double rocker mechanism having retrograde self-locking properties and being connected to the stand of the pumping assembly;

one end of an output shaft of the speed reducer/double rocker mechanism being connected with a reciprocating arm at one end of the reciprocating arm, the opposite end of the reciprocating arm being hinged to the connecting rod at one end of the connecting rod, the other end of the connecting rod being hinged to the grip.

4. A rod pumping assembly according to claim 2 wherein:

the differential phase adjusting mechanism is a liquid pump, liquid cylinder/rocker mechanism, wherein a cylindrical liquid cylinder is fixed to the stand of the pumping assembly, the inside of the liquid cylinder being divided into two liquid cavities by a piston, a liquid pump connecting the two liquid cavities in series by means of a three-position four-way valve and liquid conduits, a piston rod being fixed to the piston, an extension of said piston rod being hinged with a connecting rod at one end of the connecting rod, with the opposite end of the connecting rod being hinged to the grip.

5. The rod pumping assembly according to claim 2, wherein:

the differential phase adjusting means includes means for connecting the planet disc grip and the stand of the pumping assembly, said means for connecting including a screw stem/screw nut slider/rocker mechanism, wherein a support housing having a sliding path and being integrally formed with the stand of the pumping assembly rotatably mounts a screw stem, a screw nut being threadedly engaged with the screw stem and being fitted in a sliding manner with the sliding path of the support housing, a connecting rod being hinged to the screw nut at one end, and hinged to the planet disc grip at the other end.

6. A rod pumping assembly according to claim 1, wherein:

the walking beam underset balance mass includes a main balance case that is fixed to the walking beam and an auxiliary balance case that slides within the main balance case;

said main balance case including a frame extending from said walking beam with a sliding path defined by said frame and said auxiliary balance case being slidably fitted in said sliding path;

a positioning mechanism for said walking beam underset balance mass comprising a hoisting means with said hoisting means being supported on said walking beam and providing means for adjusting the positions of said auxiliary balance case and said main balance case relative to said walking beam.

7. A rod pumping assembly according to claim 6, wherein:

said means for adjusting the position of said auxiliary balance case includes a fixed pulley mounted on said walking beam, a reel mounted on said walking beam and having a center shaft connected to an output shaft of a speed reducer having retrograde self locking properties, a flexible connector extending from said reel over said fixed pulley and being connected to said auxiliary balance case, and means for rotating said reel about said center shaft.

8. A rod pumping assembly according to claim 1, wherein:

the walking beam underset balance mass includes a main balance case extending from said rear-end of said walking beam, a main balance block being supported by said main balance case, with said main balance case having a screw stem/screw nut mechanism for adjusting the position of said main balance block relative to the walking beam, said screw stem/screw nut mechanism comprising a screw nut rotatably supported on said walking beam and a screw stem passing through said screw nut, said screw stem being threadedly engaged with said screw nut and being connected to said main balance block.

9. A rod pumping assembly according to claim 1, wherein:

the walking beam underset balance mass includes a main balance case extending from said rear-end of said walking beam, a main balance block being supported by said main balance case, with said main balance case having a liquid pump/liquid cylinder/connecting rod mechanism for adjusting the position of said main balance block relative to said walking beam, said liquid pump/liquid cylinder/connecting rod mechanism comprising a liquid cylinder, said liquid cylinder being divided into two cavities by a piston, said piston being connected to said main balance block by a piston rod, and said two cavities being connected to each other in series through a three-position, four-way valve.

10. A rod pumping assembly according to claim 1, wherein:

the walking beam underset balance mass includes a main balance case extending from said rear-end of said walking beam, a main balance block being supported by said main balance case, said main balance case having a sliding path extending in parallel to said walking beam, said main balance block being moved along said sliding path by a screw stem/screw nut mechanism, said screw stem/screw nut mechanism having a screw nut fixed to the walking beam and a screw stem threadedly engaged with said screw nut and connected to said main balance block.

11. A rod pumping assembly according to claim 1, wherein:

said walking beam underset balance mass is connected to said walking beam by a pivotal linking member, said pivotal linking member being pivotally connected at one end to the walking beam and being fixed at an opposite end to the walking beam underset balance mass, a connecting rod extending between said walking beam underset balance mass and a screw nut, said screw nut being mounted for movement parallel to said walking beam along a screw stem, said screw stem being rotatably supported adjacent said walking beam.

12. A rod pumping assembly according to claim 1, wherein:

the walking beam underset balance mass includes a main balance case and an auxiliary balance case, the main balance case being suspended from said walking beam by a plurality of pivotal linking members;

said main balance case includes a frame with a sliding path defined by said frame and said auxiliary balance case being slidably fitted in said sliding path, said main balance case being connected by a connecting rod to a speed reducer/crank mechanism, said speed reducer/crank mechanism being mounted on said walking beam and having retrograde self-locking properties, and an output shaft of said speed reducer/crank mechanism being connected to said connecting rod by a crank.

13. A rod pumping assembly according to claim 1, wherein:

the walking beam underset balance mass includes a main balance case that is slidably mounted on said walking beam and an auxiliary balance case, said main balance case includes a frame with a sliding path defined by said frame and said auxiliary balance case being slidably fitted in said sliding path, a reel being rotatably mounted on said walking beam and being connected to a speed reducing mechanism having retrograde self-locking properties, a plurality of pulleys being mounted at first and second ends of said walking beam, a first cable being wrapped around said reel and extending from a first end of said reel, around at least one pulley mounted at said first end of said walking beam, and connected to one side of said main balance case; and a second cable being wrapped around said reel and extending from a second end of said reel, around at least one pulley mounted at said second end of said walking beam, and connected to an opposite side of said main balance case.

14. A rod pumping assembly according to claim 1, wherein:

the walking beam underset balance mass includes a main balance case extending from said rear-end of said walking beam, a main balance block being supported by said main balance case, said main balance case having a sliding path extending in parallel to said walking beam, said main balance case being moved along said sliding path by a cam controlled mechanism, said cam controlled mechanism comprising a cam controlling plate having a cam surface, said cam controlling plate being mounted on said stand, a cam follower being supported on said cam controlling plate for movement along said cam surface, and a linking member connected to said cam follower at one end of said linking member and to said main balance case at an opposite end of said linking member.

15. A rod pumping assembly according to claim 1, wherein:

front end portion of said walking beam is oriented at an obtuse angle to a rear end portion of said walking beam, said walking beam underset balance mass being slidably supported on said rear end portion, a pulley being adjustably mounted on said stand, and a flexible connector of predetermined length being connected to said front end portion, extending around said pulley, and being connected to said walking beam underset balance mass.

16. A rod pumping assembly according to claim 1, wherein:

the walking beam underset balance mass includes a main balance case extending from said rear-end of said walking beam, a main balance block being supported by said main balance case, said main balance case having a sliding path extending in parallel to said walking beam, said main balance case being moved along said sliding path by a linking mechanism, said linking mechanism including a supporting seat mounted on said stand, a connecting member extending between said supporting seat and said main balance case, said connecting member being pivotally connected to said supporting seat and said supporting seat having means for adjusting the position of said supporting seat relative to said stand.

17. A rod pumping assembly according to claim 1, wherein:

a front end portion of said walking beam is oriented at an obtuse angle to a rear end portion of said walking beam, said walking beam underset balance mass being slidably supported on said rear end portion, a supporting seat being mounted on said stand with said supporting seat having a screw stem/screw nut positioning mechanism, said screw stem/screw nut positioning mechanism having a screw stem, a screw nut threadedly engaged with said screw stem and being pivotally connected to one end of a flexible connector, and an opposite end of said flexible connector being connected to said walking beam underset balance mass.

18. A rod pumping assembly according to claim 1, wherein:

a front end portion of said walking beam is oriented at an obtuse angle to a rear end portion of said walking beam, said walking beam underset balance mass comprising a first reservoir connected to said rear end portion of said walking beam, said first reservoir having a fill opening and a discharge opening, a second reservoir being mounted on said walking beam near said bearing at said top end of said stand and having a discharge opening, said second reservoir discharge opening being controlled by a valve, ballast material being provided in said second reservoir and means for directing said ballast material from said second reservoir to said first reservoir upon actuation of said valve.

19. A rod pumping assembly according to claim 1, wherein:

a front end portion of said walking beam is oriented at an obtuse angle to a rear end portion of said walking beam, said walking beam underset balance mass comprising a main balance block suspended from said rear end portion of said walking beam by a flexible connector, said flexible connector being connected to said rear end portion of said walking beam at one of a plurality of axial spaced positions, a guide wheel being adjustably mounted on said base and contacting said flexible connector along a length of said flexible connector between said connection to said rear end portion of said walking beam and said main balance block.

* * * * *